United States Patent [19]

Irie et al.

[11] Patent Number: 4,508,600

[45] Date of Patent: Apr. 2, 1985

[54] PROCESS FOR PREPARING ZN-NI-ALLOY-ELECTROPLATED STEEL SHEETS WITH EXCELLENT ADHERENCE OF THE PLATED LAYER

[75] Inventors: Taisuke Irie; Yoshitaka Nakagawa; Masayoshi Tatano, all of Osaka; Koichi Watanabe, Amagasaki; Eiji Watanabe, Osaka, All of Japan

[73] Assignee: Nisshin Steel Company, Ltd., Tokyo, Japan

[21] Appl. No.: 601,601

[22] Filed: Apr. 18, 1984

[51] Int. Cl.[3] ..... C25D 3/56; C25D 5/10; C25D 7/00

[52] U.S. Cl. ..... 204/27; 204/40; 204/44.2; 204/44.5

[58] Field of Search ..... 204/40, 44.2, 44.5, 204/27

[56] References Cited

U.S. PATENT DOCUMENTS 2,844,530 7/1958 Wesley et al. ..... 204/40

FOREIGN PATENT DOCUMENTS 2800258 7/1978 Fed. Rep. of Germany ..... 204/40
38494 4/1981 Japan ..... 204/40
145996 9/1982 Japan ..... 204/40

OTHER PUBLICATIONS

Abner Brenner, "Electrodeposition of Alloys", vol. II, pp. 186–189, (1963).

*Primary Examiner*—G. L. Kaplan
*Attorney, Agent, or Firm*—Webb, Burden, Robinson & Webb

[57] ABSTRACT

The adhesion of a corrosion resisting Zn-Ni-alloy plated layer on a steel sheet is improved by pre-plating the steel substrate with a Zn-Ni layer containing Ni in an amount higher than said Zn-Ni-alloy plated layer.

3 Claims, No Drawings

PROCESS FOR PREPARING ZN-NI-ALLOY-ELECTROPLATED STEEL SHEETS WITH EXCELLENT ADHERENCE OF THE PLATED LAYER

TECHNICAL FIELD OF THE INVENTION

This invention relates to a process for Zn-Ni-alloy-plated steel sheets which comprises first pre-plating steel sheets with a Zn-Ni alloy containing a higher amount of Ni before effecting the principal Zn-Ni-alloy-electroplating in order to improve the adhesion of said plated layer.

BACKGROUND OF THE INVENTION

In recent years there is arising a demand for Zn-electroplated steel sheets with higher corrosion resistance especially from automobile industry circles. In compliance with this demand, improved Zn-Ni type alloy-plating of steel sheets such as Zn-Ni-alloy plating, Zn-Ni-Co-alloy plating, etc. has been developed.

Although steel sheets with such Zn-Ni type alloy electroplating is excellent in corrosion resistance in the bare state, they are inferior in the susceptibility to the phosphating (phosphate salt treatment) as the pretreatment for electrodeposition coating (electrophoretic painting). That is, uniform dense phosphate salt crystals are not formed on the plated surface, and therefore adhesion of the electrodeposited coating is not satisfactory.

There was previously developed improved Zn-Ni-alloy electroplated steel sheets, said alloy containing a slight amount of Ti, Co, etc. in order to overcome the above-mentioned problem, which is described in the copending Ser. No. 555,711. Said process comprises electroplating steel sheets in an acidic plating bath containing 10–40 g/l (gram as atom per liter bath) zinc, 15–160 g/l nickel, 0.2–10 g/l titanium, 0.1–5 g/l cobalt and 0.1–5 g/l aluminum or 0.2–4 g/l magnesium, the pH of which is 1.5–2.5.

The plated steel sheets obtained by this process have remarkably improved adhesion of electrodeposited coatings (electrophoretically painted layer) and are excellent in corrosion resistance in the bare state, since the plated layer contains a slight amount of Ti which is uniformly distributed in the plated layer and works as nuclei for crystalization of phosphate salts in the phosphating.

However, the adhesion of the plated layer to the substrate steel sheet in the above-mentioned plated steel sheets is not quite satisfactory. The plated layer on which a thick electrodeposited coating is applied is liable to be peeled off from the steel substrate by impulsive deformation, since the electrodeposited coating is dense and hard per se and is firmly bonded to the plated layer so that the latter suffers strong compressive stress. For instance, the plated layer on which an electrodeposited coating of more than 15μ is applied is easily peeled off when tested by a Du Pont impulse tester. Thus, the above-mentioned improved Zn-Ni-alloy-electroplated steel sheet is not quite satisfactory as a substrate for electrodeposition coating.

We proceeded with research for improving adhesion of said plated Zn-Ni alloy layer to the steel substrate and have found that the adhesion can be improved by pre-electroplating substrate steel sheets with a Zn-Ni alloy using an electroplating bath of a specific composition under specific conditions before effecting said Zn-Ni electroplating.

DISCLOSURE OF THE INVENTION

This invention provides a process for preparing Zn-Ni-alloy plated steel sheets with excellent adhesion of the plated layer comprising pre-plating a steel sheet in an acidic plating bath containing 7–38 g/l Zn and 41–88 g/l Ni whereby the concentration ratio $[Ni^{2+}]/([Zn^{2+}]+[Ni^{2+}])$ is 0.70–0.85 with an electric current density of 2–20 A/dm$^2$ at a temperature between 55° and 80° C. so that the resulting Zn-Ni pre-plated layer contains 12–87 wt % Ni; and electroplating said pre-plated steel sheet in an acidic electroplating bath containing 25–33 g/l Zn, 41–88 g/l Ni, 0.2–10 g/l titanium and 0.1–5 g/l aluminum or 0.2–4 g/l magnesium, the pH of which is 1.5–2.5.

Preferably, the Zn content of the pre-plating bath is 11–34 g/l and the Ni content thereof is 62–79 g/l.

More preferably, the Zn content of the pre-plating bath is 15–30 g/l and the Ni content thereof is 85–70 g/l.

In the improved Zn-Ni-alloy-plating process which we previously developed, the composition of the electroplated layer which gives products of most stable quality essentially consists of 10–12% by weight nickel, 0.005–1% by weight titanium, 0.01–0.5% by weight cobalt, 0.001–2% by weight aluminum and the balance zinc, or 8–16% by weight nickel, 0.005–1% by weight titanium, 0.05–0.5% by weight cobalt, 0.001–1% by weight magnesium and the balance zinc.

In accordance with this invention, the adhesion of the steel substrate and the above-mentioned principal Zn-Ni-alloy-plated layer is improved by pre-plating the substrate with another Zn-Ni alloy.

The pre-electroplated layer must contain a higher amount of Ni than the principal Zn-Ni-alloy-electroplated layer. According to our study, the pre-plated layer must contain more than 12 wt % and not more than 87 wt % Ni.

For the pre-plating bath, a chloride bath, a sulfate bath or a mixed chloride/sulfate bath can be employed. The bath should contain 7–38 g/l Zn ions and 41–88 g/l Ni ions, whereby the concentration ratio $[Ni^{+2}]/([Zn^{2+}]+[Ni^{2+}])$ must be 0.70–0.85. By employment of such a bath the Ni content of 12 wt % to 87 wt % is achieved. The plating bath preferably contains 11–34 g/l Zn and 62–72 g/l Ni, more preferably 15–30 g/l Zn and 85–70 g/l Ni.

When electroplating is effected in a bath containing $Zn^{2+}$ and $Ni^{2+}$, adhesion between the pre-plated layer and the steel substrate and adhesion between the pre-plated layer and the principal plated layer are influenced by electric current density, and smaller densities give better adhesion and increase Ni content in the resulting plated layer. Although it is preferred to carry out the electroplating with lower current density in order to improve adhesion, the Ni content in the pre-plated layer exceeds 87 wt % when current density of less than 2 A/dm$^2$ is employed.

In this condition, if cracking occurs in the principal plated layer, corrosion of the principal plated layer is promoted although it is temporarily protected. This is probably because the corrosion electrolytic potential of the pre-plated layer is higher than that of the principal plated layer. As the result, adhesion between the principal plated layer and the coating gradually is deteriorated. Therefore, electroplating must be carried out with a current density of not less than 2 A/dm$^2$. On the other hand, when current density is in excess of 20 $A/dm^2$, the Ni content of the pre-plated layer becomes close to that of the principal plated layer. This means that adhesion of the pre-plated layer to the steel substrate is weakened to the same level as that of said Zn-Ni-alloy plating. Therefore, adhesion is improved by carrying out the pre-electroplating with a current density of between 2 and 20 $A/dm^2$.

If the Ni content of the pre-plated layer is lower than or of the same level as that of the principal plated layer, adhesion of the principal plated layer to the steel substrate is not sufficient, and the pre-plated layer is preferentially corroded when cracking occurs in the principal plated layer and thus the plated layers are peeled off. Therefore, the Ni content of the pre-plated layer must be higher than that of the principal plated layer, that is, higher than 12 wt % and not higher than 87 wt % when the pre-plating is carried out under the above-mentioned currency condition. Thus, the corrosion potential of the pre-plated layer is higher than the principal plated layer and that the difference in the corrosion potential from that of the principal plated layer is not too large, and corrosion between the steel substrate and the principal plated layer is inhibited and good adhesion and endurance of coatings are brought about. The Ni content of the pre-plated layer more preferable for inhibiting corrosion between the steel substrate and the principal plated layer is 17–42 wt %, that is, higher than that of the principal plated layer by 5–30 wt %.

In order to make the Ni content of the pre-plated layer more than 12 wt % and not less than 87 wt %, further the pre-electroplating should preferably be carried out at a temperature between 55° and 80° C. If the concentration ratio $[Ni^{2+}]/([Zn^{2+}]+[Ni^{2+}])$ *is less than* 0.70 and the bath temperature is lower than 55° C., the Ni content in the pre-plated layer becomes less than 12 wt %. If the ratio is in excess of 0.85, the Ni content of the resulting plated layer fluctuates and pre-plated layers of uniform quality cannot be produced. If the bath temperature is in excess of 80° C., it gives no advantage, only requiring a special material for bath vessels and an excess of energy for warming the bath.

In order to achieve the preferred Ni content of 17–42 wt % in the pre-plated layer as mentioned above, the electroplating should be conducted in a bath of which said concentration ratio is 0.70–0.77 at 65°–80° C. or the ratio is 0.77–0.80 at 55°–65° C.

The thickness of the pre-plated layer should be not less than 0.05 μm. With pre-plating thinner than this, no improvement in corrosion resistance is expected. If the thickness is in excess of 1 μm, it will invite cracking in the pre-plating layer when the sheet is subjected to deformation, which is undesirable for corrosion prevention. Therefore the thickness of the pre-plated layer should be 0.05–1 μm.

The principal plated layer is formed by electroplating steel sheets with an acidic plating bath containing 25–33 g/l (gram as atom per liter bath) zinc 41–88 g/l nickel, 0.2–10 g/l titanium, 0.1–5 g/l cobalt and 0.1–5 g/l aluminum or 0.2–4 g/l magnesium, the pH of which is 1.5–2.5.

The details of the process for applying the principal electroplated layer is described in the specification of Serial No. 555,711, which is incorporated in this specification by reference.

As has been explained in the above, this invention improves adhesion of the plated Zn-Ni-alloy layer by applying a pre-plated layer in which the Ni content is higher than that of the principal plated layer with relatively low current density. Although the reason why electroplating with such low current density brings about better adhesion is not quite clearly understood, it is surmised that the pre-plated layer of which the Ni content is higher than that of the principal plated layer causes a crystal growth different from that of the principal plated layer, which contributes to the better adherence of the plated layers.

It has been confirmed that adhesion of the plated layer is not impaired if a slight amount of another metal such as Co, Cr, Ti, Fe, etc. is codeposited in the pre-plated layer when a pre-plated layer contains more than 12 wt % and not more than 87 wt % Ni.

DETAILED DESCRIPTION OF THE EMBODIMENTS

Examples

Cold-rolled steel sheets 0.8 mm in thickness were degreased and pickled by the conventional method, and were pre-plated with a Zn-Ni alloy and thereafter was subjected to the Zn-Ni-alloy-plating using baths as indicated in Table 1.

Cation

The plated sheets were pre-treated with a commercially available phosphating solution (DT-3030 supplied by Nippon Parkerizing Corporation) and subjected to electrodeposition coating (20 μm thick coating) using a cation type electrodeposition solution supplied by Nippon Paint Co. (Power-Top U-30) at 200 V for 3 minutes, the coated sheets were baked at 180° C. for 20 minutes. Adhesion between the steel substrate and the principal plated layer and adhesion between the principal plated layer and the coated film were checked. The tests were carried out using a Du Pont impact tester (1 kg weight, 50 cm dropping distance). An adhesive tape was applied to the deformed part and the tape was forcibly detached, and peel-off of the coated layer or the coated layer with plated layer was observed. The test of adhesion of coating was carried out with samples as coated (primary adherence test) and samples after having been soaked in water of 40° C. for 240 hours (secondary adhesion test). The results are shown in Table 2 together with compositions of the plated layers. The evaluation standard is shown in Table 3.

The pre-plating baths of this invention and comparative baths contained 85–70 gNi/l nickel sulfate, 15–30 g Zn/l zinc sulfate and 36 g/l sodium sulfate, and the pH of the baths was 2. Within the above ranges, the $[Ni^{2+}]/([Zn^{2+}]+[Ni^{2+}])$ ratio was varied.

The principal plating baths contained 49 gNi/l nickel sulfate, 25 gZn/l zinc sulfate, 72 g/l sodium sulfate, 1 gCo/l cobalt sulfate, 5.2 gAl/l aluminum sulfate and 3 gTi/l. The pH of the baths was 2.

It is apparent from Table 2 that coated steel sheets prepared using the plated steel sheets with pre-plating in accordance with this invention are remarkably superior to the above-mentioned Zn-Ni plated steel sheets in both the primary adhesion test and the secondary adhesion test.

As has been explained above, the adhesion of Zn-Ni-alloy electroplated layer is remarkably improved by pre-electroplating another Zn-Ni alloy in accordance with this invention. The plated layer is fully resistant to impulsive deformation with electrodeposition coating thereon.

TABLE 1

| Plating Bath | | Pre-Plating Bath Composition: $\frac{[Ni^{2+}]}{[Zn^{2+}]+[Ni^{2+}]}$ | Third Element Added (g/l) | Current Density (A/dm²) | Temp. (°C.) | Zn—Ni—Alloy Plating Bath: $\frac{[Ni^{2+}]}{[Zn^{2+}]+[Ni^{2+}]}$ | Current Density (A/dm²) | Temp. (°C.) | Purpose of Comparative Examples |
|---|---|---|---|---|---|---|---|---|---|
| Baths of This Invention | 1 | 0.70 | — | 2 | 70 | 0.65 | 40 | 55 | |
| | 2 | 0.70 | — | 5 | 65 | " | " | " | |
| | 3 | 0.75 | — | 2 | 60 | " | " | " | |
| | 4 | 0.75 | — | 20 | 75 | " | " | " | |
| | 5 | 0.80 | — | 10 | 55 | " | " | " | |
| | 6 | 0.85 | — | 10 | 60 | " | " | " | |
| | 7 | 0.70 | $Co^{2+}$; 1.5 | 5 | 60 | " | " | " | |
| | 8 | 0.70 | $Cr^{3+}$; 0.2 | 5 | 60 | " | " | " | |
| | 9 | 0.70 | $Fe^{2+}$; 0.4 | 5 | 60 | " | " | " | |
| | 10 | 0.70 | $Ti^{4+}$; 0.4 | 5 | 60 | " | " | " | |
| Comparative Baths | 1 | 0.65 | — | 20 | 52 | " | " | " | $\frac{[Ni^{2}]}{[Zn^{2+}]+[Ni^{2+}]} < 0.70$, Temp. <55° C. |
| | 2 | 0.90 | — | 2 | 70 | " | " | " | $\frac{[Ni^{2}]}{[Zn^{2+}]+[Ni^{2+}]} > 0.85$ |
| | 3 | 0.70 | — | 25 | 52 | " | " | " | Current Density > 20 A/dm² Temp. <55° C. |
| | 4 | 0.70 | — | 1 | 60 | " | " | " | Current Density < 2 A/dm² |
| | 5 | 0.70 | — | 30 | 60 | " | " | " | Current Density < 20 A/dm² |
| | 6 | — | — | — | — | " | " | " | No pre-plating |
| | 7 | — | — | — | — | " | " | " | Zn—Ni Alloy Plating only |

TABLE 2

| Plated Sheets | | Pre-Plated Layer (0.2 μm): Ni Content (Wt %) | Third Element Added (Wt %) | Principal Plated Layer (20 g/m²): Ni Content (Wt %) | Ti Content (cps) | Adhesion of Plated Layer and Coating: Primary Adhesion Test: Coating/Plated Layer | Plated Layer/Substrate | Secondary Adhesion Test: Coating/Plated Layer | Plated Layer/Substrate |
|---|---|---|---|---|---|---|---|---|---|
| Plated Sheets of This Invention | 1 | 86 | — | 12 | 200 | 5.0 | No peeling | 4.0 | Slight peeling |
| | 2 | 19 | — | " | 180 | 4.5 | " | 4 | No peeling |
| | 3 | 71 | — | " | 210 | 5.0 | " | 4.5 | " |
| | 4 | 23 | — | " | 170 | 4.5 | " | 4 | " |
| | 5 | 14 | — | " | 190 | 4.5 | " | 4 | " |
| | 6 | 21 | — | " | 185 | 4.5 | " | 4.5 | " |
| | 7 | 17 | 0.2 | " | 200 | 4.5 | " | 4.5 | " |
| | 8 | 17 | 0.05 | " | 195 | 4.5 | " | 4.5 | " |
| | 9 | 17 | 0.1 | " | 175 | 4.5 | " | 4.5 | " |
| | 10 | 17 | 20 (cps) | " | 194 | 4.5 | " | 4.5 | " |
| Comparative Plated Sheets | 1 | 10 | — | " | 180 | 4.0 | Peeling of large area | 3 | Peeling of large area |
| | 2 | 94 | — | " | 192 | 5.0 | No peeling | 3 | Slight peeling |
| | 3 | 12 | — | " | 186 | 4.5 | Peeling of large area | 3 | Peeling of large area |
| | 4 | 91 | — | " | 175 | 4.5 | No peeling | 3 | Slight peeling |
| | 5 | 12 | — | " | 178 | 4.0 | Peeling of large area | 3 | Peeling of large area |
| | 6 | — | — | " | 178 | 4.5 | Nearly total peeling | 3 | Nearly total peeling |
| | 7 | — | — | " | 0 | 4.0 | Nearly total peeling | 1 | Nearly total peeling |

NOTE:
The Ti content in the principal plated layer was measured by X-ray fluorescence analysis with system 3080 made by Rigaku Denki K.K., 50 kV - 40 mA.

TABLE 3

| Rating | Area of Peeling |
|---|---|
| 5 | No peeling |
| 4.5 | less than 1.0% |
| 4 | 1-10% |
| 3 | 11-30% |
| 2 | 31-70% |
| 1 | 71-99% |
| 0 | Whole area |

We claim:

1. A process for preparing Zn-Ni-alloy plated steel sheets with excellent adhesion of the plated layer comprising pre-plating a steel sheet in an acidic plating bath containing 7-38 g/l Zn and 41-88 g/l Ni whereby the concentration ratio $[Ni^{2+}]/([Zn^{2+}]+[Ni^{2+}])$ is 0.70-0.85 with an electric current density of 2-20 A/dm² at a temperature between 55° and 80 ° C. so that the resulting Zn-Ni pre-plated layer contains 12-87 wt % Ni; and electroplating said pre-plated steel sheet in an acidic electroplating bath containing 25-33 g/l Zn, 41-88 g/l Ni, 0.2-10 g/l titanium and 0.1-5 g/l aluminum or 0.2-4 g/l magnesium, the pH of which is 1.5-2.5.

2. The process as described in claim 1, wherein the Zn content of the pre-plating bath is 11-34 g/l and the Ni content thereof is 62-79 g/l.

3. The process as described in claim 1, wherein the Zn content of the pre-plating bath is 15-30 g/l and the Ni content thereof is 85-70 g/l.

* * * * *